US006386934B1

(12) United States Patent
Mifune et al.

(10) Patent No.: US 6,386,934 B1
(45) Date of Patent: May 14, 2002

(54) METHOD OF MANUFACTURING ELECTRONIC TUBE

(75) Inventors: Tatsuo Mifune, Katano; Tsumoru Ohata, Kyoto; Akihiro Horikawa, Osaka, all of (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 09/722,747

(22) Filed: Nov. 28, 2000

Related U.S. Application Data

(62) Division of application No. 09/081,813, filed on May 21, 1998, now Pat. No. 6,172,449.

(30) Foreign Application Priority Data

May 23, 1997 (JP) ..... 9-132689

(51) Int. Cl.[7] ..... H01J 29/07
(52) U.S. Cl. ..... 445/47
(58) Field of Search ..... 445/47; 313/402

(56) References Cited

U.S. PATENT DOCUMENTS 4,442,376 A 4/1984 Van Der Waal et al.
4,734,615 A * 3/1988 Koike et al. ..... 313/402
4,884,004 A * 11/1989 Deal et al. ..... 313/402
4,983,136 A * 1/1991 Okuda et al. ..... 445/47
5,170,093 A * 12/1992 Yamamoto et al. ..... 313/402
5,256,932 A 10/1993 Watanabe et al.
5,814,928 A 9/1998 Matsudate et al.

FOREIGN PATENT DOCUMENTS

JP 9-17349 1/1997

* cited by examiner

*Primary Examiner*—Kenneth J. Ramsey
(74) *Attorney, Agent, or Firm*—Parkhurst & Wendel, L.L.P.

(57) ABSTRACT

The present invention has an object to provide a method of manufacturing an electronic tube capable of eliminating deterioration of image quality due to an excessively high electron reflection effect of a material comprising a metal element with an atomic number not lower than 70 and painted on a shadow mask and deterioration of image quality due to spontaneous peeling of a coat on the surface of the shadow mask. A paint mainly comprising a solated metal oxide or a metal alkoxide of an element with an atomic number not lower than 40 is painted to form an electron reflection coat with an amount of coating of less than 2 mg/cm$^2$ so as to achieve coating on an electron gun side surface of a shadow mask. With this method, an electronic tube with good image quality can be manufactured.

9 Claims, 9 Drawing Sheets

| ATOMIC NUMBER | COMPOUND | RESULTS OF EVALUATION OF DOMING | DETERIORATION OF IMAGE QUALITY DUE TO SCATTERED ELECTRONS |
|---|---|---|---|
| 38 | STRONTIUM OXIDE | INCOMPATIBLE | NO PROBLEM |
| 39 | YTTRIUM OXIDE | INCOMPATIBLE | NO PROBLEM |
| 40 | ZIRCONIUM OXIDE | COMPATIBLE | NO PROBLEM |
| 42 | MOLYBDENUM OXIDE | COMPATIBLE | NO PROBLEM |
| 48 | CADMIUM OXIDE | COMPATIBLE | NO PROBLEM |
| 56 | BARIUM OXIDE | COMPATIBLE | NO PROBLEM |
| 58 | CERIUM OXIDE | COMPATOBLE | NO PROBLEM |
| 62 | SAMARIUM OXIDE | COMPATIBLE | NO PROBLEM |
| 67 | HOLMIUM OXIDE | COMPATIBLE | NO PROBLEM |
| 73 | TANTALUM OXIDE | COMPATIBLE | LARGE DETERIORATION OF IMAGE QUALITY |
| 82 | LEAD OXIDE | COMPATIBLE | LARGE DETERIORATION OF IMAGE QUALITY |
| 83 | BISMUTH OXIDE | COMPATIBLE | LARGE DETERIORATION OF IMAGE QUALITY |

FIG. 3

| AMOUNT OF COATING (mg /cm$^2$ ) | RESULTS OF EVALUATION OF DOMING | RESULTS OF EVALUATION OF SPONTANEOUS PEELING |
|---|---|---|
| 0.10 | COMPATIBLE | NO PEELING |
| 0.15 | COMPATIBLE | NO PEELING |
| 0.18 | COMPATIBLE | NO PEELING |
| 0.20 | COMPATIBLE | SPONTANEOUS PEELING PARTIALLY OBSERVED |
| 0.30 | COMPATIBLE | SPONTANEOUS PEELING LARGELY OBSERVED |
| 0.40 | COMPATIBLE | SPONTANEOUS PEELING LARGELY OBSERVED |

FIG. 4

| ATOMIC NUMBER | COMPOUND | RESULTS OF EVALUATION OF DOMING | DETERIORATION OF IMAGE QUALITY DUE TO SCATTERED ELECTRONS |
|---|---|---|---|
| 38 | STRONTIUM OXIDE | INCOMPATIBLE | NO PROBLEM |
| 39 | YTTRIUM OXIDE | INCOMPATIBLE | NO PROBLEM |
| 40 | ZIRCONIUM OXIDE | COMPATIBLE | NO PROBLEM |
| 42 | MOLYBDENUM OXIDE | COMPATIBLE | NO PROBLEM |
| 48 | CADMIUM OXIDE | COMPATIBLE | NO PROBLEM |
| 56 | BARIUM OXIDE | COMPATIBLE | NO PROBLEM |
| 58 | CERIUM OXIDE | COMPATIBLE | NO PROBLEM |
| 62 | SAMARIUM OXIDE | COMPATIBLE | NO PROBLEM |
| 67 | HOLMIUM OXIDE | COMPATIBLE | NO PROBLEM |
| 73 | TANTALUM OXIDE | COMPATIBLE | NO PROBLEM |
| 82 | LEAD OXIDE | COMPATIBLE | NO PROBLEM |
| 83 | BISMUTH OXIDE | COMPATIBLE | NO PROBLEM |

FIG. 6

| AMOUNT OF COATING ($mg/cm^2$) | RESULTS OF EVALUATION OF DOMING | RESULTS OF EVALUATION OF SPONTANEOUS PEELING |
|---|---|---|
| 0.10 | COMPATIBLE | NO PEELING |
| 0.15 | COMPATIBLE | NO PEELING |
| 0.18 | COMPATIBLE | NO PEELING |
| 0.20 | COMPATIBLE | SPONTANEOUS PEELING PARTIALLY OBSERVED |
| 0.30 | COMPATIBLE | SPONTANEOUS PEELING LARGELY OBSERVED |
| 0.40 | COMPATIBLE | SPONTANEOUS PEELING LARGELY OBSERVED |

FIG. 7

| ATOMIC NUMBER | METAL SUBSTANCE | RESULTS OF EVALUATION OF DOMING | DETERIORATION OF IMAGE QUALITY DUE TO SCATTERED ELECTRONS |
|---|---|---|---|
| 38 | STRONTIUM | INCOMPATIBLE | NO PROBLEM |
| 39 | YTTRIUM | INCOMPATIBLE | NO PROBLEM |
| 40 | ZIRCONIUM | COMPATIBLE | NO PROBLEM |
| 42 | MOLYBDENUM | COMPATIBLE | NO PROBLEM |
| 48 | CADMIUM | COMPATIBLE | NO PROBLEM |
| 56 | BARIUM | COMPATIBLE | NO PROBLEM |
| 58 | CERIUM | COMPATIBLE | NO PROBLEM |
| 62 | SAMARIUM | COMPATIBLE | NO PROBLEM |
| 67 | HOLMIUM | COMPATIBLE | NO PROBLEM |
| 73 | TANTALUM | COMPATIBLE | NO PROBLEM |
| 82 | LEAD | COMPATIBLE | NO PROBLEM |
| 83 | BISMUTH | COMPATIBLE | NO PROBLEM |

FIG. 8

| AMOUNT OF COATING (mg /cm $^2$) | RESULT S OF EVALUATION OF DOMING | RESULTS OF EVALUATION OF SPONTANEOUS PEELING |
|---|---|---|
| 0.10 | COMPATIBLE | NO PEELING |
| 0.15 | COMPATIBLE | NO PEELING |
| 0.18 | COMPATIBLE | NO PEELING |
| 0.20 | COMPATIBLE | NO PEELING |
| 0.30 | COMPATIBLE | NO PEELING |
| 0.40 | COMPATIBLE | NO PEELING |

FIG. 9

| ATOMIC NUMBER | COMPOUND | RESULTS OF EVALUATION OF DOMING | DETERIORATION OF IMAGE QUALITY DUE TO SCATTERED ELECTRONS |
|---|---|---|---|
| 38 | STRONTIUM OXIDE | INCOMPATIBLE | NO PROBLEM |
| 39 | YTTRIUM OXIDE | INCOMPATIBLE | NO PROBLEM |
| 40 | ZIRCONIUM OXIDE | COMPATIBLE | NO PROBLEM |
| 42 | MOLYBDENUM OXIDE | COMPATIBLE | NO PROBLEM |
| 48 | CADMIUM OXIDE | COMPATIBLE | NO PROBLEM |
| 56 | BARIUM OXIDE | COMPATIBLE | NO PROBLEM |
| 58 | CERIUM OXIDE | COMPATOBLE | NO PROBLEM |
| 62 | SAMARIUM OXIDE | COMPATIBLE | NO PROBLEM |
| 67 | HOLMIUM OXIDE | COMPATIBLE | NO PROBLEM |
| 73 | TANTALUM OXIDE | COMPATIBLE | LARGE DETERIORATION OF IMAGE QUALITY |
| 82 | LEAD OXIDE | COMPATIBLE | LARGE DETERIORATION OF IMAGE QUALITY |
| 83 | BISMUTH OXIDE | COMPATIBLE | LARGE DETERIORATION OF IMAGE QUALITY |

METHOD OF MANUFACTURING ELECTRONIC TUBE

This is a Division of application Ser. No. 09/081,813 filed May 21, 1998. Now U.S. Pat. No. 6,172,449.

FIELD OF THE INVENTION

The present invention relates to a method of manufacturing an electronic tube for a television or a computer.

BACKGROUND OF THE INVENTION

Conventionally, a method of manufacturing an electronic tube described in the Japanese Patent Application Laid-Open No. 59-94325 is known.

The configuration of an electronic tube for a television or a computer is shown in FIG. 1. The reference number 1 denotes a shadow mask, 1*a* an electron gun side surface of the shadow mask, 2 an electron gun, 3 a fluorescent screen, 4 electron beam, and 5 an electronic tube.

The shadow mask 1 formed of metal material is provided with a plurality of round or rectangular apertures on the whole surface so that electrons are projected only to desired micropositions on the fluorescent screen 3.

Although electron beam 4 irradiated from the electron gun 2 is projected to the whole shadow mask 1, only electrons passing through said apertures of the shadow mask 1 reach the fluorescent screen 3 to form an image.

Since the number of electrons colliding against the shadow mask 1 is sometimes larger than that of electrons passing through the apertures of the shadow mask 1, however, the kinetic energy of the colliding electrons is converted into thermal energy to elevate temperature of the shadow mask 1 to about 70° C. or higher.

Thermal expansion of the shadow mask 1 following said elevation in temperature causes dislocation of the apertures of the shadow mask 1 and thus changes the positions of electrons irradiated on the fluorescent screen 3, leading to distortion of an image. Such a change in beam position caused by thermal expansion of a whole shadow mask, which results from irradiation of electron beam from an electron gun contained in an electronic tube to the whole surface of a fluorescent screen, is called "doming."

According to the conventional method of manufacturing an electronic tube 5, since an appropriate amount of coating of a paint containing a metal element with an atomic number not lower than 70 is considered to be not lower than 0.2 $mg/cm^2$ but not higher than 2 $mg/cm^2$ in order to suppress this doming, bismuth oxide powder and the like having a large effect of reflecting electrons (hereinbelow, referred to as electron reflection effect) has been painted on the electron gun side surface 1*a* of the shadow mask.

The electron reflection effect is known to be related to the atomic number of a material and to increase as the atomic number increases.

When material with a high electron reflection effect, such as bismuth oxide, is painted on the electron gun side surface 1*a* of a shadow mask, conversion of kinetic energy of electrons into thermal energy is prevented, since projected electrons are reflected by the surface 1*a* and do not enter the shadow mask 1.

Consequently, an elevation in temperature of the shadow mask 1 is prevented so that doming caused by thermal expansion can be suppressed and a problem of image distortion be solved.

DISCLOSURE OF THE INVENTION

In the conventional method of manufacturing an electronic tube, paint containing a metal element with an atomic number not lower than 70 has been painted. The conventional method has, however, been suffered from such a problem, due to excessively high electron reflection effect, that electrons reflected on the electron gun side surface of a shadow mask scatter in the electronic tube and the scattered electrons are projected even to such areas of a fluorescent screen as requiring no electron projection, thereby deteriorating image quality.

In the conventional method of manufacturing an electronic tube, an appropriate amount of coating of a paint containing a metal element with an atomic number not lower than 70 is considered to be not lower than 0.2 $mg/cm^2$ but not higher than 2 $mg/cm^2$. However, since the amount of painting in this range is higher than required, there is such a problem that peeling of paint material from the surface of a shadow mask occurs in an electronic tube after the electronic tube is completed, causing pollution inside the electronic tube and resulting in deterioration of image quality.

An object of the present invention is to provide an excellent method of manufacturing an electronic tube by minimizing doming and solving the problem of deterioration of image quality.

In order to solve the above-mentioned problem, the present invention relating to a method of manufacturing an electronic tube provides a method of manufacturing an electronic tube in which an electron reflection coat is formed on the electron gun side surface of a shadow mask to an amount of coating of less than 2 $mg/cm^2$ by painting a paint mainly comprising a solated metal oxide or a metal alkoxide of an element with an atomic number not lower than 40. By using the above-mentioned paint, including the case where an element with an atomic number not lower than 70 is used, an electron reflection effect becomes appropriate to provide a good image quality.

In addition, the paint comprising a metal element with an atomic number not lower than 40 is coated on the electron gun side surface of a shadow mask by a sputtering method or a vapor deposition method to achieve coating with an amount of coating of less than 0.2 $mg/cm^2$, thereby to manufacture an electronic tube making a same effect as mentioned above.

The method of manufacturing an electronic tube according to the present invention can provide an electronic tube with less doming and good image quality.

The present invention will be now illustrated in more detail. According to the first aspect of the present invention, a method of manufacturing an electronic tube is provided which is characterized in that an electron reflection coat is formed on the electron gun side surface of the shadow mask to an amount of coating of less than 2 $mg/cm^2$ by painting a paint mainly comprising a solated metal oxide of an element with an atomic number not lower than 40, said method giving an excellent image quality due to an appropriate electron reflection effect achieved by the paint comprising the metal oxide in a sol state. It is also characterized in that one of sodium silicate, potassium silicate, and lithium silicate or a mixture thereof is used as a binder and water is used as a solvent for the paint. It is also characterized in that the electron reflection coat may be formed by a spray method or a spin coating method.

According to the second aspect of the present invention, a method of manufacturing an electronic tube is provided which is characterized in that an electron reflection coat is formed on the electron gun side surface of a shadow mask to an amount of coating of less than 2 $mg/cm^2$ by painting a paint mainly comprising a metal alkoxide of an element with an atomic number not lower than 40, said method achieving an effect similar to that mentioned above even using metal alkoxides. Similarly, it is also characterized in that an electron reflection coat may be formed by a spray method or a spin coating method.

According to the third aspect of the present invention, a method of manufacturing an electronic tube is provided which is characterized in that an electron reflection coat mainly comprising an element with an atomic number not lower than 40 is formed on the electron gun side surface of a shadow mask to an amount of coating of less than 0.2 $mg/cm^2$ and also in that the electron reflection coat is formed by a sputtering method or a vapor deposition method. The coat thus formed becomes fine, and spontaneous peeling of the coat does not occur. Accordingly, good image quality can be obtained.

According to the fourth aspect of the present invention, an electronic tube is provided which is characterized in that an electron reflection coat is formed on the electron gun side surface of the shadow mask to an amount of coating of less than 2 $mg/cm^2$, said electron reflection coat mainly comprising an element with an atomic number not lower than 40 and not higher than 69.

According to the fifth aspect of the present invention, an electronic tube is provided which is characterized in that an electron reflection coat is formed on the electron gun side surface of the shadow mask to an amount of coating of less than 0.2 $mg/cm^2$, said electron reflection coat mainly comprising an element with an electron number not lower than 70.

BRIEF DESCRIPTION OF THE DRAWINGS

FIG. 3 shows the relations of doming and spontaneous peeling of coat to an amount of coating in a sputtering method according to Example 1 of the present invention;

FIG. 4 shows the relations of doming and deterioration of image quality due to scattered electrons to atomic number in the sputtering method according to Example 1 of the present invention;

FIG. 6 shows the relations of doming and spontaneous peeling of coat to amount of coating in a vapor deposition method according to Example 2 of the present invention;

FIG. 7 shows the relations of doming and deterioration of image quantity due to scattered electrons to atomic number in the vapor deposition method according to Example 2 of the present invention;

FIG. 8 shows the relations of doming and spontaneous peeling of coat to average amount of coating in a spin coating method according to Example 3 of the present invention; and FIG. 9 shows the relations of doming and deterioration of image quality due to scattered electrons to atomic number in the spin coating method according to Example 3 of the present invention.

DESCRIPTION OF THE EMBODIMENT

Examples of the present invention will be illustrated below.

EXAMPLE 1

A method of coating the electron gun side surface of a shadow mask by a sputtering method is described.

Figure 1:
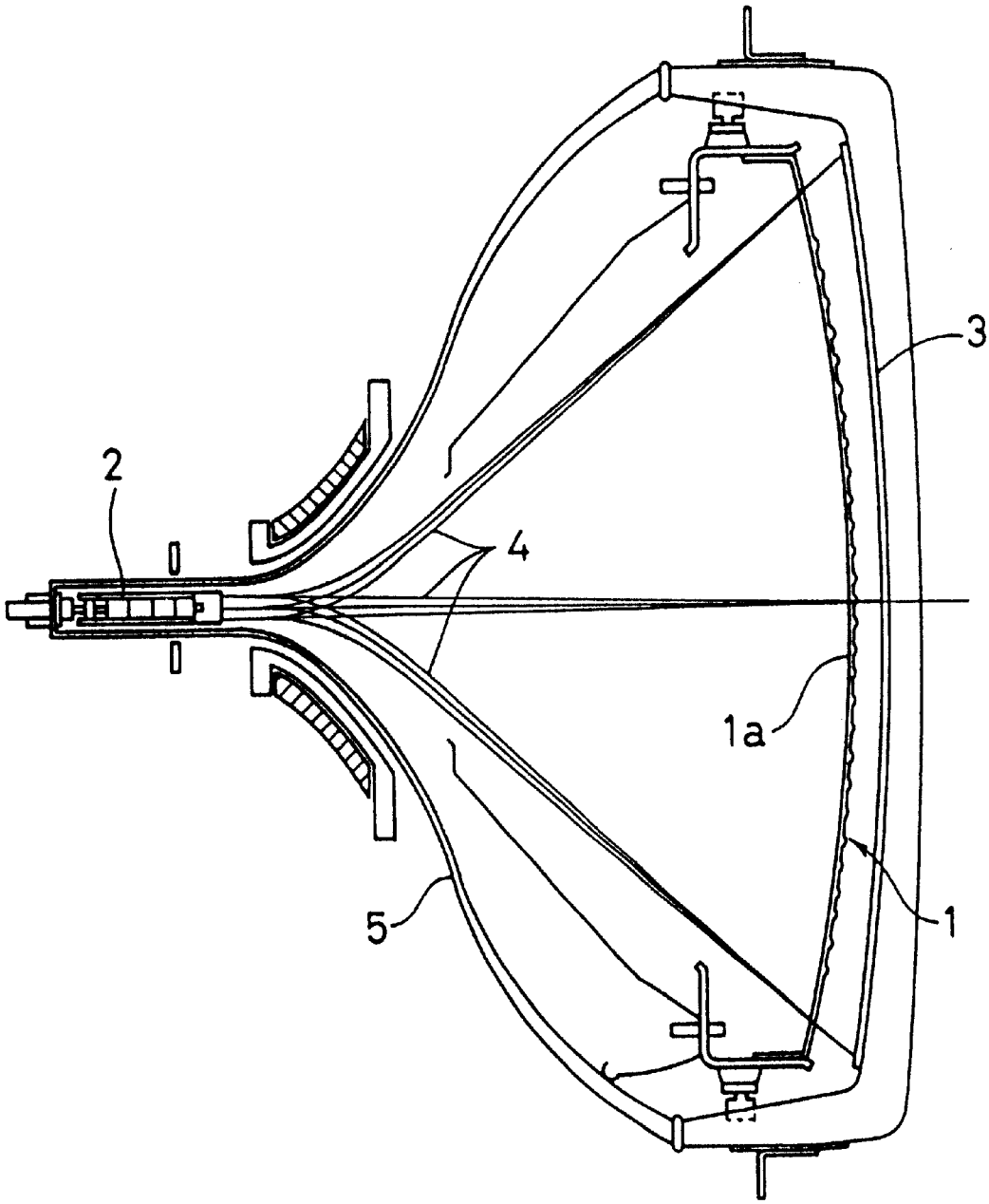
FIG. 1 is a cross-sectional view of a common structure of a conventional electronic tube and an electronic tube of the present invention.
Figure 2:
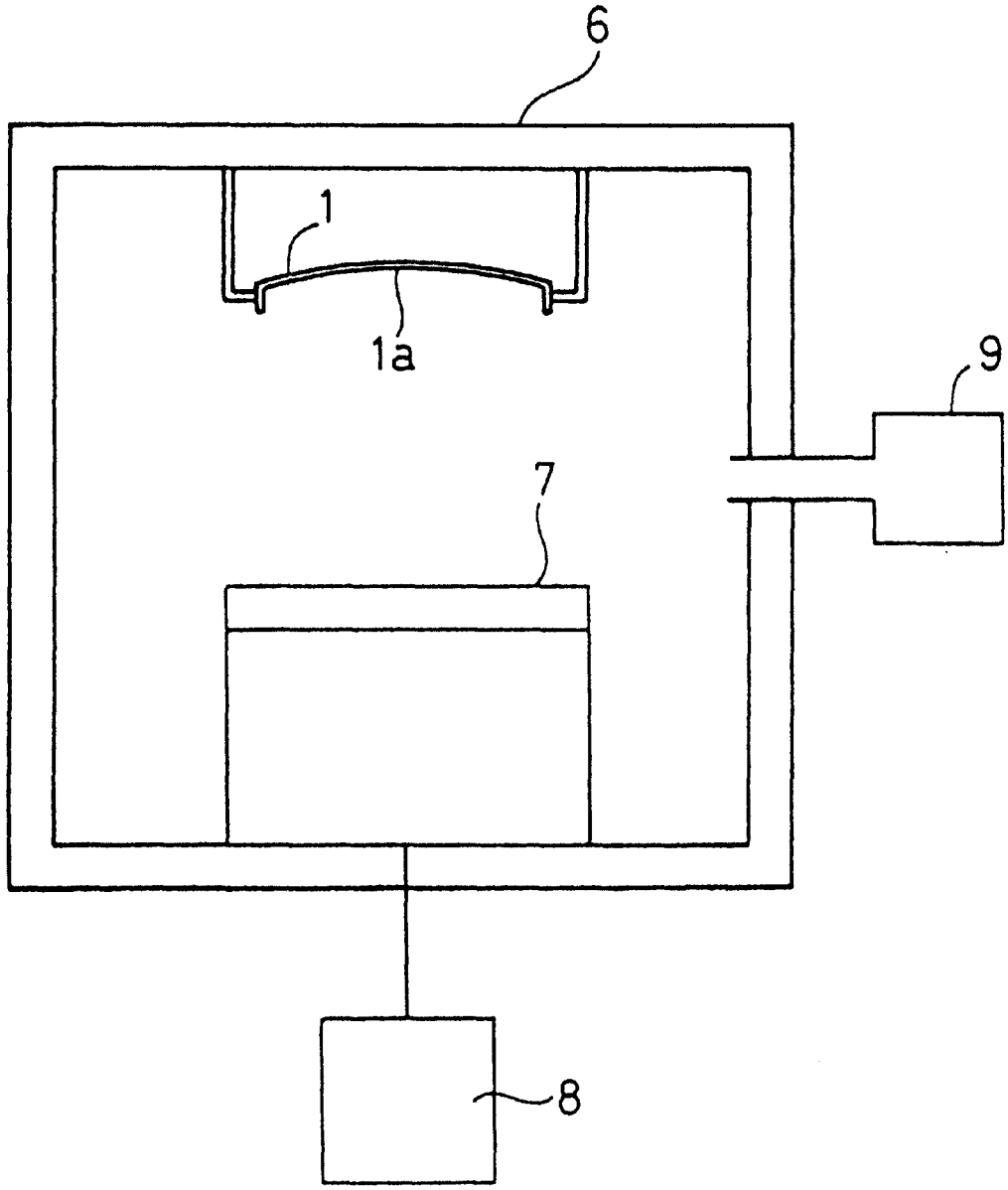
FIG. 2 shows a configuration of a sputtering apparatus according to Example 1 of the present invention.

FIG. 2 shows a configuration of a sputtering apparatus.

Reference number 1 denotes a shadow mask, 1*a* an electron gun side surface of the shadow mask, 6 a chamber, 7 a sputtering target, 8 a high-frequency power source, and 9 a gas output.

Since coating is formed on the electron gun side surface 1*a* of the shadow mask, the shadow mask 1 is placed so as to face the electron gun side surface 1*a* of the shadow mask toward a sputtering target 7.

Sintered bismuth oxide was used as the sputtering target 7. The size of the sputtering target 7 used was about twice the surface area of one side of the shadow mask 1, in order to reduce the influence of coat thickness distribution during coating.

The coating speed is determined by gas flow rate from the gas output 9 to the inside of the chamber 6 and power applied to the sputtering target 7 from the high-frequency power source 8. A coating speed increases as a gas flow rate increases and power applied by the high-frequency power source 8 becomes larger.

In this example, coating was performed with a coating speed ranging from 0.001 $\mu$m/min to 0.01 $\mu$m/min in order to facilitate control of coat thickness.

The relation between coat thickness and amount of coating is such that, in the case of bismuth oxide, when coat thickness is 0.2 $\mu$m, then an amount of coating is 0.2 $mg/cm^2$.

Samples of a shadow mask 1 with different amounts of bismuth oxide coating were prepared by the sputtering method. After the samples were assembled into an electronic tube 5, doming was evaluated and spontaneous peeling of the bismuth oxide coat was examined. The results are shown in FIG. 3.

A method of evaluating doming adopted in this example is described below. In order to evaluate doming, changes in beam spot position are observed microscopically and quantified under irradiation of electron beam to the whole fluorescent screen as mentioned above. First, at about 3 minutes from the initiation of beam irradiation, expansion of the whole shadow mask due to temperature rise is balanced with cooling by heat radiation so that the beam spot positions stop changing. For example, when a shadow mask with electron reflection coating material is used to assemble an electronic tube and then doming is measured, an amount of change in beam position under the saturated condition expressed by X $\mu$m is smaller than an amount of doming for an uncoated shadow mask expressed by Y $\mu$m. As an evaluation criteria, $(X/Y)\times 100$=doming suppression rate (%) is used, and a doming suppression rate not higher than 60% was determined to be compatible.

During a life testing generally for 10,000-hours or longer, a coating material is sometimes spontaneously peeled off and the above-mentioned suppression rate reduces. Products with the suppression rate exceeding 60% are considered as defects. The results of evaluating doming shown in FIG. 3 are obtained in accordance with the criteria.

From the results shown in FIG. 3, with an amount of coating of less than 0.2 $mg/cm^2$, no spontaneous peeling occurs and doming is small so that such products can be sufficiently usable in practical use.

Samples of shadow masks 1 in which oxides of metal elements with different atomic numbers are coated to an amount of coating of 0.18 mg/cm$^2$ by the above-mentioned sputtering method were prepared and assembled into electronic tubes 5. Then, doming was evaluated and deterioration of image quality due to scattered electrons was examined. The results are shown in FIG. 4.

The judgment criteria for deterioration of image quality in the figure are described below. Only a red color of the fluorescent screen is displayed and the values of x and y are measured with a CIE color-presenting system using a color-difference calorimeter. Z is calculated from the values obtained according to the following equation:

$$z=1-(x+y)$$

The z of the standard fluorescent screen is expressed as z0, which represents z of a fluorescent screen of a shadow mask with no coating material applied. The degree of deterioration of image quality is called halation level. Halation level H is expressed by the following equation:

$$H=\{(z-z0)/z0\}\times 100$$

It can be said that a smaller H shows a lower degree of image quality deterioration. When H is large, colors other than red from a fluorescent screen are mixed (halation), and image quality becomes bad. Halation not higher than 10 is determined to be compatible.

The results shown in FIG. 4 indicate that when metal elements with an atomic number not lower than 40 are used, doming is small and no problem of image quality deterioration due to scattered electrons occurs.

When an atomic number is not lower than 70, since an electron reflection effect is excessively high, in general, there has been a problem of image quality deterioration due to scattered electrons. If a sputtering method was used, however, since the surface of the coat was smooth, no deterioration of image quality due to scattered electrons was observed.

From above, when material comprising a metal element with an atomic number not lower than 40 is coated on an electron gun side surface 1*a* of a shadow mask to an amount of coating of less than 0.2 mg/cm$^2$ using a sputtering method, an electronic tube with small doming and an excellent image quality can be obtained.

EXAMPLE 2

A method of coating an electron gun side surface of a shadow mask by a vapor deposition method will be described below.

Figure 5:
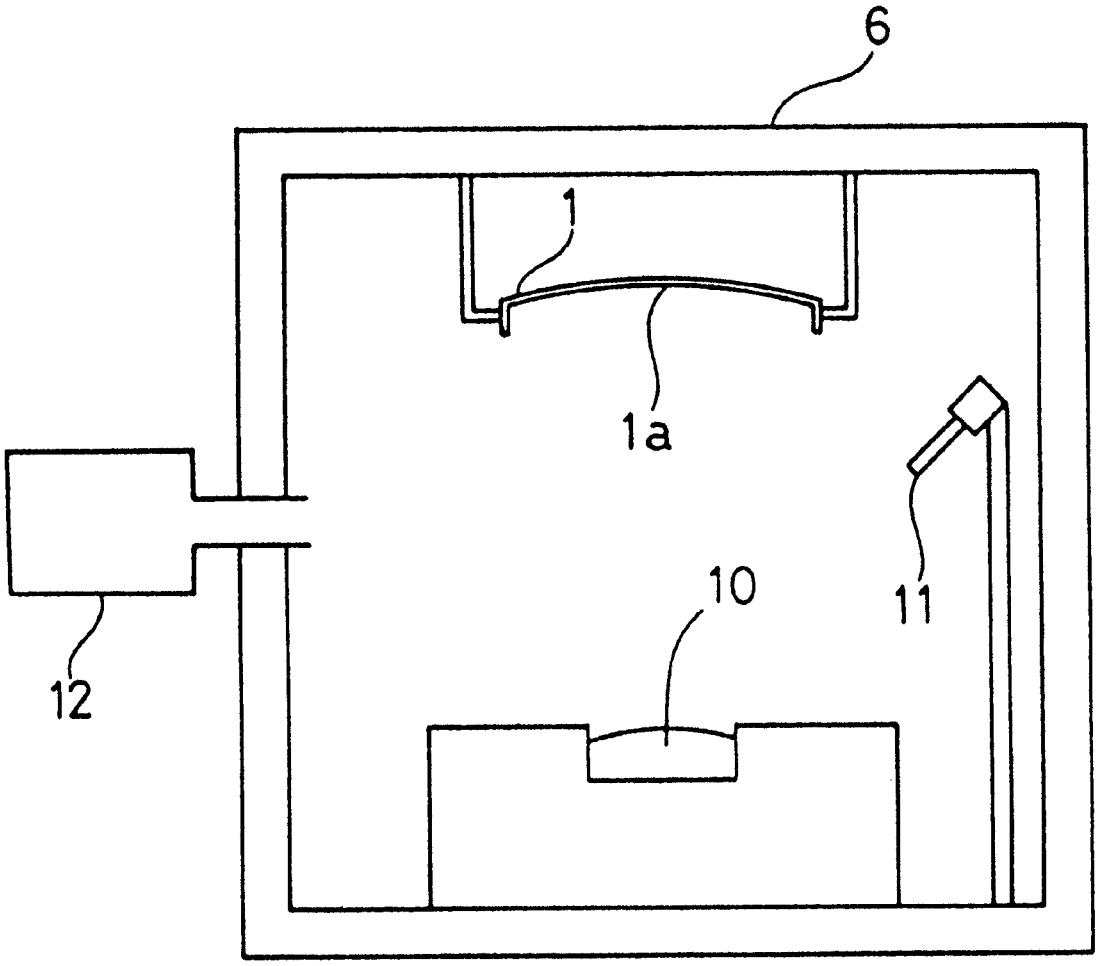
FIG. 5 shows a configuration of a vapor deposition apparatus according to Example 2 of the present invention.

FIG. 5 shows a configuration of vapor deposition apparatus.

Reference number 1 denotes a shadow mask, 1*a* an electron gun side surface of a shadow mask, 6 a chamber, 10 an evaporation source, 11 an electron beam source, and 12 a vacuum pump.

Since coating is formed on the electron gun side surface 1*a* of the shadow mask, the electron gun side surface 1*a* of the shadow mask is placed opposing the evaporation source 10.

The inside of the chamber 6 was evacuated by the vacuum pump 12 and electrons were projected convergently on the evaporation source 10 using metal bismuth from the electron beam source 11, then metal bismuth of the evaporation source 10 became hot and was evaporated to form coating on the electron gun side surface 1*a* of the shadow mask.

Using the above-mentioned vapor deposition method, shadow mask 1 samples with different amounts of metal bismuth coating were prepared and assembled into electronic tubes 5. Then, doming was evaluated and spontaneous peeling of the coat was examined. The results are shown in FIG. 6.

From the results shown in FIG. 6, when an amount of coating is less than 0.2 mg/cm$^2$, no spontaneous peeling occurs and doming is small so that the shadow masks thus obtained can be sufficiently usable in practice.

Then, shadow mask 1 samples were prepared by coating metal elements with different atomic numbers to an amount of coating of 0.18 mg/cm$^2$ using the above-mentioned vapor deposition method and assembled into electronic tubes 5. Then, doming was evaluated and deterioration of image quality due to scattered electrons was examined. The results are shown in FIG. 7.

From the results shown in FIG. 7, when metal elements with an atomic number not lower than 40 are used, doming is small and no problematic deterioration of image quality due to scattered electrons occurs.

When an atomic number is not lower than 70, since an electron reflection effect is excessively high, there has been a problem of image quality deterioration due to scattered electrons. When a vapor deposition method was used, however, since the surface of the coat was smooth, as in the case of a sputtering method, no image quality deterioration due to scattered electrons was observed.

From above, when material comprising a metal element with an atomic number not lower than 40 is coated on an electron gun side surface 1*a* of a shadow mask to a coating amount less than 0.2 mg/cm$^2$ using a vapor deposition method, as in the case of a sputtering method, an electronic tube with small doming and an excellent image quality can be obtained.

EXAMPLE 3

A method of painting a paint on an electron gun side surface of a shadow mask using a spin coating method is described.

Cerium oxide powder and pure water were weighed to a ratio of 1 to 10 and mixed.

Then, 10 parts by weight of a potassium silicate solution in water per 100 parts by weight of cerium oxide powder were weighed and mixed to the mixture.

The mixture was mixed in a ball mill for about 24 hours to obtain a paint. The paint was painted on the electron gun side surface of the shadow mask by the spin coating method and dried.

Shadow mask samples with different amounts of coating of the paint were prepared with the above-mentioned spin coating method and assembled into electronic tubes. Then doming was evaluated and spontaneous peeling of the coat was examined. The results are shown in FIG. 8.

From the results shown in FIG. 8, even when an amount of coating was not lower than 0.2 mg/cm$^2$ but not higher than 0.4 mg/cm$^2$, doming was small and no peeling of the coat on the shadow mask was observed.

Then, shadow mask samples were prepared by painting paints comprising metal elements with different atomic numbers to an average amount of coating of 0.18 mg/cm$^2$ with the above-mentioned spin coating method and assembled into electronic tubes 5. Then, doming was evaluated and deterioration of image-quality due to scattered electrons was examined. The results are shown in FIG. 9.

From the results shown in FIG. 9, when metal elements with an atomic number not lower than 40 are used, doming is small and no problematic deterioration of image quality due to scattered electrons occurs.

From the above results, excellent electronic tubes with small doming can be obtained by painting a paint comprising a metal element with an atomic number not lower than 40 but not higher than 69 on an electron gun side surface of a shadow mask to an amount of coating of not lower than 0.1 $mg/cm^2$ but not higher than 0.4 $mg/cm^2$ using the spin coating method.

Although sodium silicate was employed as a binder, similar results can be obtained even when one of sodium silicate, potassium silicate, and lithium silicate or a mixture thereof is used.

Similar results can be obtained, when a paint comprising alkoxide of metals with an atomic number not lower than 40 but not higher than 69 is employed instead of the above-mentioned paints.

Similar results can be also obtained, when a paint comprising a solated metal element with an atomic number not lower than 40 but not higher than 69 is employed instead of the above-mentioned paints.

Similar results can be obtained, when a spray method is used instead of the above-mentioned spin coating method for painting.

As described above, according to the method of manufacturing an electronic tube of the present invention, coat of a paint mainly comprising solated metal oxide or metal alkoxide of an element with an atomic number not lower than 40 with an amount of coating of less than 2 $mg/cm^2$ exerts an appropriate electron reflection effect, produces less doming, and causes no deterioration of image quality due to scattered electrons so that excellent electronic tubes can be obtained.

In addition, for paint mainly comprising an element with an atomic number not lower than 40, when coating is performed by a sputtering method or a vapor deposition method to an amount of coating of less than 0.2 $mg/cm^2$, no spontaneous peeling of coat occurs and thus deterioration of image quality following pollution inside an electronic tube due to spontaneous peeling of the coat can be eliminated. Especially, in case of coating by a sputtering method or a vapor deposition method, since the surface of the coat is smooth, no deterioration of image quality due to scattered electrons occurs.

What is claimed is:

1. A method of manufacturing an electronic tube in which among electron beams irradiated from an electron gun, only those passing through a plurality of apertures of a metal shadow mask are projected to a fluorescent screen to generate a visible light, characterized in that an electron reflection coat is formed on the electron gun side surface of said shadow mask to an amount of coating of less than 0.2 $mg/cm^2$ by painting a paint mainly comprising a solated metal oxide of an element with an atomic number not lower than 40.

2. The method of manufacturing an electronic tube according to claim 1, wherein one of a group consisting of sodium silicate, potassium silicate and lithium silicate or a mixture thereof is used as a binder.

3. The method of manufacturing an electronic tube according to claim 1, wherein water is used as a solvent for a paint.

4. A method of manufacturing an electronic tube in which among electron beams irradiated from an electron gun, only those passing through a plurality of apertures of a metal shadow mask are projected to a fluorescent screen to generate a visible light, characterized in that an electron reflection coat is formed on the electron gun side surface of said shadow mask to an amount of coating of less than 0.2 $mg/cm^2$ by painting a paint mainly comprising a metal alkoxide of an element with an atomic number not lower than 40.

5. The method of manufacturing an electronic tube according to any one of claims 1 to 4, wherein the electron reflection coat is formed by a spray method or a spin coating method.

6. A method of manufacturing an electronic tube for manufacturing an electronic tube in which among electron beams irradiated from an electron gun, only those passing through a plurality of apertures of a metal shadow mask are projected to a fluorescent screen to generate a visible light, characterized in that an electron reflection coat mainly comprising an element with an atomic number not lower than 40 is formed on the electron gun side surface of said shadow mask to an amount of coating of less than 0.2 $mg/cm^2$.

7. The method of manufacturing an electronic tube according to claim 6, wherein the electron reflection coat is formed by a sputtering method or a vapor deposition method.

8. A method of manufacturing an electronic tube in which among electron beams irradiated from an electron gun, only those passing through a plurality of apertures of a metal shadow mask are projected to a fluorescent screen to generate a visible light, characterized in that an electron reflection coat is formed on the electron gun side surface of said shadow mask to an amount of coating of not less than 0.2 $mg/cm^2$ and less than 2 $mg/cm^2$ by painting a paint mainly comprising a solated metal oxide of an element with an atomic number from 40 to 69.

9. A method of manufacturing an electronic tube in which among electron beams irradiated from an electron gun, only those passing through a plurality of apertures of a metal shadow mask are projected to a fluorescent screen to generate a visible light, characterized in that an electron reflection coat is formed on the electron gun side surface of said shadow mask to an amount of coating of not less than 0.2 $mg/cm^2$ and less than 2 $mg/cm^2$ by painting a paint mainly comprising a metal alkoxide of an element with an atomic number from 40 to 69.

* * * * *